US005413023A

United States Patent [19]

Babel et al.

[11] Patent Number: 5,413,023

[45] Date of Patent: May 9, 1995

[54] ELASTOMERIC PREPREG ROVING COMPOSITE

[75] Inventors: Henry W. Babel, Huntington Beach; Robert F. Reizer, Stanton, both of Calif.

[73] Assignee: McDonnell Douglas Corporation, Huntington Beach, Calif.

[21] Appl. No.: 813,812

[22] Filed: Dec. 27, 1985

[51] Int. Cl.[6] ..... F42D 1/08

[52] U.S. Cl. ..... 86/21; 264/3.1; 102/291; 428/500

[58] Field of Search ..... 102/289, 290, 291; 428/500; 264/3.1–3.6; 86/21

[56] References Cited

U.S. PATENT DOCUMENTS

| | | | |
|---|---|---|---|
| 2,938,233 | 5/1960 | Nack et al. | 264/3.5 X |
| 3,348,445 | 10/1967 | Nadel | 102/289 X |
| 4,013,743 | 3/1977 | Blasche, Jr. et al. | 264/3.1 |
| 4,385,948 | 5/1983 | Reed, Jr. et al. | 264/3.1 X |
| 4,405,534 | 9/1983 | Diesenroth | 264/3.5 X |
| 4,507,165 | 3/1985 | Herring | 102/289 X |
| 4,608,210 | 8/1986 | Müller et al. | 264/3.2 |

*Primary Examiner*—Peter A. Nelson
*Attorney, Agent, or Firm*—John P. Scholl; Roger Turner

[57] ABSTRACT

An elastomeric prepreg wherein a carrier, whether roving, yarn, broad goods or tape, is impregnated with an uncured elastomeric rubber system which may include the addition of modifiers to enhance the properties of the coating. The prepreg is capable of being spooled and de-spooled for subsequent filament winding or laid up into laminates. In either process no environmental control equipment is required as the volatiles have previously been removed, leaving the elastomer in the generally uncured state.

5 Claims, No Drawings

ELASTOMERIC PREPREG ROVING COMPOSITE

BACKGROUND OF THE INVENTION

The present invention relates generally to the manufacturer of elastomeric products, and more particularly articles of manufacturer wherein a yarn or roving is preimpregnated with an elastomeric matrix for subsequent, delayed, filament winding or making into laminates and to the processes for making such compositions. The product is what is known in the art as an "elastomeric prepreg."

Various elastomerics have been used as major or minor constituents of coating compositions, frequently blended with other materials which effect the properties of the coatings. However, up until now, the manufacturer of these elastomeric systems have been performed in situ, involving wet winding. Elastomers include natural rubber or synthetic elastomeric polymers. Wet winding requires dissolving the rubber elastomer in a mixture of solvents. Control of the solvents required to put many of the elastomers e.g. VAMAC rubber, which is a trademark for a elastomeric polymer manufactured by DuPont, into solution requires the use of extensive environmental control equipment. This equipment is not available at most filament winders. Manufacturers of typical nonelastomeric composites involving such well-known rovings as fiberglass, Kevlar, and graphite when combined with their resin systems do not usually require such environmental control equipment because there are no toxics or carcinogens driven off during the process. However, for manufacturing convenience, epoxy, phenolic, polyesters, and some other systems are currently available in prepreg form. In all of these prepregs the cure of the resins is started but not completed and are known as B-stage materials.

While all of these prior art products are somewhat related they are all distinguishable over the present invention in that they are either non-elastomerics or if they involve elastomerics they are cured, in situ. Tire manufacturing is a typical process involving elastomeric composites which are totally cured. Pressure-sensitive adhesives are examples of elastomerics which are at least partially cured.

The object of this invention is to provide a prepreg wherein the yarn or roving is impregnated with an elastomeric matrix which is wound on spools or rolls for later use in filament winding or making into laminates.

It is a further object of this invention to provide a rubber matrix impregnated yarn or roving, unlimited in types, wound on spools or rolls for subsequent filament winding or making into laminates without the use of special environmental control equipment to control the solvents required to put the rubber matrix in solution.

Still another object of the present invention is to provide a yarn or roving preimpregnated with an elastomeric matrix system which is left in the uncured state as opposed to a partially cured state by the removal of the solvents required in order to coat the yarn or roving with an elastomeric matrix.

Another object of the present invention is to provide an elastomeric prepreg for winding on the outside skin of a missile so as to provide an integral over wrap shield or by applying layers with impregnated cloth material to the outer surfaces of a graphite composite structure. These outer layers provide damage resistance and insulation required for specified solid propellant motor cases, all to be finally cured by the application of heat and pressure.

SUMMARY OF THE INVENTION

The present invention provides a yarn or roving preimpregnated with an elastomeric polymer coating, essentially dried of the solvents used in the coating operation with the elastomeric polymer left in the generally uncured state, capable of being spooled and de-spooled for subsequent filament winding or making into laminates in the case of a unidirectional or cloth prepreg. In either final process, winding or layup, no environmental control equipment is required.

In a typical embodiment the elastomeric polymer is first combined with 5–50% by weight of inert particulate inorganic material referred to herein as a modifier since it modifies the characteristics of the coating, enhancing the final winding or layup. The modifier has an average size of 0.1–15 microns depending on the specific modifier. Percentages herein are based on the combined weight of the elastomeric polymer and the modifier, unless stated otherwise.

Alternatively, the process of making the elastomeric prepreg described above consists of mixing an elastomer on a rubber mill or Banbury internal mixer, addition of the modifier if required, in 20 parts to 100 parts by weight, addition of the curing ingredients and accelerator. After thorough mixing, the mixture is calendered into a sheet and chopped and placed into a suitable mixer such as a sigma blade mixer with suitable solvents. Additional additives such as a novalac epoxy are then added along with the curing agent e.g. BDMA (benzyl dimethyl amine) to obtain a liquid with 10–50% solids and a consistency desirable for the selected method of coating. For example, from 100–1,000 parts by weight of diluent per 100 parts of the elastomer and modifier will provide a quite satisfactory consistency for use with a tower coater. Varying the amount of a diluent to effect a desired paste consistency is well within the basic knowledge of the artisan and needs no further discussion here.

The selected carrier, roving or woven fabric, to be impregnated is then coated with the above elastomeric system. The solids are then precipitated in and on the carrier by driving off 95–99.5% of the volatiles without substantially advancing the cure, depending on the particular elastomeric system and the desired subsequent process. Some systems may require multiple passes.

The impregnated and dried system is then wound on a spool or roll and depending on the blocking which occurs it may be necessary to use a suitable separator e.g. release paper, polyethylene film, etc. The technique of preventing blocking or sticking between adjacent layers of the carrier is a basic skill in the art and needs no further discussion here.

If a long term storage of the prepreg is required and if the selected elastomeric system advances the cure at room temperature the product will have to be refrigerated for storage.

DETAILED DESCRIPTION OF THE INVENTION

The invention is a prepreg consisting of a carrier impregnated with an elastomer polymer coating with or without the addition of an inert modifier. The carrier may be a roving, yarn, unidirectional tape, woven cloth or non-woven fabrics of interbonding fibers. The elastomeric polymer is maintained in the generally uncured state and the impregnated carrier is capable of being spooled and de-spooled for subsequent use in filament winding or making into laminates depending on the nature of the carrier. There are no restrictions on the elastomeric matrices. In the winding or layup process no environmental control equipment is required as essentially all of the solvents have been removed from the elastomeric matrix. The choice of elastomer is also without limitations. It may be rubber, natural or synthetic, homopolymers or copolymers, or a mixture of two polymers. Also, the only limitations on the modifier, so called because it modifies the characteristics of the coating, is that it be an inert substance and the particle size be very small, in the range between 0.5–15 microns.

The prepreg product of this invention is used generally as other prepregs previously known in the art e.g. epoxy phenolic, polyester, and other systems in that the roving is wound on another article or wound to the desired shape or layed up, in the case of broad goods rovings, and then cured by the application of heat and/or pressure.

Prepregs of this invention may be made by placing an elastomeric polymer in a piece of mixing equipment e.g. a rubber mill or Banbury internal mixer so as to band and warm-up the gum rubber with the blade set medium tight; e.g., a 75 mil gap. When Kevlar pulp is added, a tight mill gap of 1–5 mils is required and blended with the preheated polymer. The polymer mix is then combined with 20 to 100 parts by weight of an inert filler or modifier selected to produce the desired characteristics in the elastomeric system and mixed in a kneading operation. After grinding and kneading, the polymer mix is combined with suitable curing ingredient and an accelerator, mixed and calendered into sheets. The sheets are then chopped up and placed in a suitable mixer such as a sigma blade mixer along with suitable solvents to obtain a mixture with 10–40% solids. Additional additives such as an epoxy can then be introduced along with its curing agent so as to obtain a 10–50% solid content and mixed. This is the final coating and its consistency must be adjusted by the addition of suitable diluents so as to achieve a viscosity compatible with whatever method of coating or impregnating is selected e.g. knife, brush, roller or dip coating. Varying the amount of diluent to effect the desired viscosity is well within the basic knowledge of the artisan.

95–99.5% of the volatiles are then driven off, depending on the particular rubber system and the intended final use of the prepreg, by heating, leaving the precipitated solids in and on the carrier generally in an uncured state ready for placing on the spool. This operation is typically performed in an apparatus known as a treater or tower which combines a dip tank and oven with some means for removing excess coating from the roving. If excessive blocking takes place, a suitable separator must be used between layers on the spool. Also, if the cure advances at room temperature the spooled product must be refrigerated to prevent advancing of the cure.

The invention will be further clarified by a consideration of the following examples which are intended to be purely exemplary of the use of the invention. A hundred parts of VAMAC (G), an eythelene acrylic rubber made by DuPont, was placed in a piece of mixing equipment either a rubber mill or a Banbury internal mixer and mixed for about one minute with the blade gap set at .075 inches so as to band and warm up the rubber. Two parts of Naugard 445, an antioxident and trade name of Uniroyal, Inc., is placed in the mixer with the elastomeric gum and mixed for approximately a minute which protects the rubber from oxidizing during this entire process. 6.5 parts of Kevlar ® (a registered mark of the DuPont Chemical Co.) pulp which was previously dried for 16 hours at approximately 250° F. so as to drive off the approximately 11% moisture normally in the Kevlar. The dried Kevlar was placed in the mill with the mill set at 0.005 inches, very tight, and mixed for 12 to 15 minutes.

Twenty parts of Boron Nitride was then added to the mixer with the mixer gap set at 0,100 inches and mixed for 15 minutes so as to comminute the entire mix. The mixture was then cooled down and three parts of Titanium Dioxide added to the mixture and with the mixer set at 0.075 inches blade clearance, mixed for 5 minutes. Curing ingredients, 1.25 parts Diak No. 1 (hexameythlene diamine carbamate) manufactured by DuPont Chemical Co. and 4 parts DPG (diphenyl guanidine), which is an accelerator, were combined with the above, mixed, calendered into a sheet and then chopped up into pieces approximately ½ by 1 inch. The chopped pieces were placed in a sigma blade mixer along with the solvents, which include 65 parts MEK (methyl ethyl ketone), 10 parts MIBK (methyl isobutal) 15 parts ethyl acetate and 10 parts toluene. This combination with the solvents was mixed and allowed to sit 16 hours so that the rubber swells and goes into solution. The sigma blade mixer is run for 4 hours or until the mix is uniform and free of lumps. Finally, 10 parts DEN Resin 438, Dow epoxy Novalac, a product of Dow Chemical Co., along with its curing agent BDMA Benzyl Dimethylamine at 0.2 parts are added. This solution, containing 10 to 40% solid content, must have the consistency and viscosity suitable for the impregnating system used. This piece of equipment is normally called a Treater or Tower which contains a dip tank and oven wherein the roving or cloth is dipped into the elastomeric system, squeegeed by whatever means required in that particular system and the solids were precipitated on and in the carrier, roving or cloth, by driving off 99.5% of the volatiles. The impregnated carrier, in this case a Kevlar 29 yarn, manufactured by DuPont Chemical Co., was then placed on a spool without any separators for subsequent use.

Another system identical to the above was made except the Kevlar pulp was excluded.

A third system, similar to the above was made using VAMAC B-124 rubber, 124 parts, to which was added N339 Black, which is a carbon powder and mixed as above. Four parts of DPG and 1.25 parts Diak No. 1 were added along with Armeen 18D which is an octadelyl amine release agent and Zelac UN 0.5 parts which is a processing aid and 0.5 parts Stearic Acid, all of which were mixed, calendered and impregnated as described above.

Other embodiments of this invention will be apparent to those skilled in the art from a consideration of this specification or practice of this invention as disclosed herein. It is intended that the specification and examples be considered as exemplary only, with the true scope and spirit of the invention being indicated by the following claims.

What is claimed is:

1. An elastomeric prepreg comprising a carrier impregnated with an elastomeric polymer system wherein said elastomeric polymer system is 95 to 99.5% free of solvents and is essentially in the uncured condition.

2. The elastomeric prepreg of claim 1 further comprising means for containing said elastomeric prepreg adapted for easy removal in a subsequent winding or layup process.

3. The elastomeric prepreg of claim 1 further comprising a modifier dispersed in said elastomeric polymer system wherein said modifier consists of an inert discontinuous particulate phase of 10–50% by weight of the combined weight of the elastomeric polymer system and the modifier.

4. The elastomeric prepreg of claim 2 wherein said means for containing said elastomeric prepreg is a spool or roll.

5. The elastomeric prepreg of claim 3 wherein the average size of the modifier is 0.1–15 microns.

* * * * *